US006283012B1

(12) United States Patent
Kato et al.

(10) Patent No.: US 6,283,012 B1
(45) Date of Patent: Sep. 4, 2001

(54) COMPRESSOR PISTON AND METHOD FOR COATING PISTON

(75) Inventors: Takayuki Kato; Takahiro Sugioka; Shigeo Fukushima, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/457,238

(22) Filed: Dec. 8, 1999

(30) Foreign Application Priority Data

Dec. 9, 1998 (JP) ..... 10-349864

(51) Int. Cl.[7] ..... F04B 39/00
(52) U.S. Cl. ..... 92/155
(58) Field of Search ..... 92/155, 248

(56) References Cited

U.S. PATENT DOCUMENTS

| | | | | |
|---|---|---|---|---|
| 4,389,921 | * | 6/1983 | Bush | 92/59 |
| 4,519,119 | | 5/1985 | Nakayama et al. | 29/156.5 R |
| 5,266,142 | | 11/1993 | Penrice | 92/223 X |
| 5,314,717 | | 5/1994 | Alt | 92/223 X |
| 5,376,454 | * | 12/1994 | Sugasawa et al. | 428/421 |
| 5,435,873 | | 7/1995 | Penrice . | |
| 5,469,777 | * | 11/1995 | Rao et al. | 92/223 |
| 5,482,637 | * | 1/1996 | Rao et al. | 252/29 |
| 5,486,299 | | 1/1996 | Fuwa et al. | 252/12 |
| 5,616,406 | * | 4/1997 | Nakamaru et al. | 442/19 |
| 5,626,907 | * | 5/1997 | Hagiwara et al. | 427/202 |
| 5,655,432 | * | 8/1997 | Wilkosz et al. | 92/71 |
| 5,700,093 | | 12/1997 | Hiramatsu et al. | 384/276 |
| 5,763,068 | * | 6/1998 | Kishino et al. | 428/323 |
| 5,941,160 | * | 8/1999 | Kato et al. | 92/155 |
| 5,941,161 | | 8/1999 | Kimura et al. | 92/155 |
| 5,943,941 | * | 8/1999 | Kato et al. | 92/12.2 |
| 5,996,467 | * | 12/1999 | Churgay et al. | 92/71 |

FOREIGN PATENT DOCUMENTS

| | | |
|---|---|---|
| 19754028A1 | 6/1998 | (DE) . |
| 0818625A2 | 1/1998 | (EP) . |
| 55-084880 | 6/1980 | (JP) . |
| 10-026081 | 1/1998 | (JP) . |
| 10-169557 | 6/1998 | (JP) . |
| 10-299654 | 11/1998 | (JP) . |

* cited by examiner

*Primary Examiner*—John E. Ryznic
(74) *Attorney, Agent, or Firm*—Morgan & Finnegan, LLP

(57) ABSTRACT

A compressor piston that smoothly slides in a cylinder bore and a coating method for manufacturing such pistons. Coating material is applied to a piston to form a coating layer. The principal components of the material include fluororesin and a binder. The coating layer is not ground. Therefore, fluororesin, which migrates to the surface of the coating layer, is not removed by grinding, which permits the piston to resist friction.

16 Claims, 4 Drawing Sheets

| Region of Layer | Weight Ratio (Fluororesin/Binder) |
|---|---|
| Outer Surface | 0.75 |
| Middle | 0.48 |
| Inner Surface | 0.05 |
| Overall | 0.46 |

COMPRESSOR PISTON AND METHOD FOR COATING PISTON

The present invention relates to pistons for compressors that are used in vehicle air conditioners and to a method for coating pistons.

Compressors are employed in air-conditioning systems for vehicles. Piston type compressors are used in such systems. Pistons having no piston rings are known in the art. Such a piston directly contacts the wall of the corresponding cylinder bore and must have good sliding and sealing characteristics and high wear resistance. The surface of a ringless piston is therefore coated. The principal components of the coating include fluororesin and binder. The fluororesin permits the piston to reciprocate smoothly in the cylinder bore. The binder firmly adheres the coating layer to the surface of the piston.

The coating layer is formed by applying a coating material on a piston and curing it thereafter. Then, the coating layer is ground to make the thickness of the coating layer uniform.

The current methods for producing coated pistons have some drawbacks. First, the grinding of the coating layer requires precision and high manufacturing skills, which complicates the process of manufacturing of the pistons and lowers the production efficiency.

Also, the fluororesin in the coating layer is deposited in a zone proximate to the surface of the coating layer. Much of the fluororesin is thus removed when the surface of the coating layer is ground. The sliding characteristics of the piston may therefore deteriorate, which lowers the compression efficiency of the compressor.

SUMMARY OF THE INVENTION

Accordingly, it is an objective of the present invention to provide a piston that has improved sliding characteristics and a piston coating method that is highly efficient.

To achieve the foregoing and other objectives and in accordance with the purpose of the present invention, a piston for reciprocating in a cylinder bore of a compressor is provided. The piston includes a head for contacting a wall of the cylinder bore and a coating layer formed on an outer surface of the head. The coating layer includes fluororesin and a binder. The surface of the coating layer has a relatively high concentration of the fluororesin for reducing friction when the piston reciprocates.

In another aspect of the present invention, a method of coating a compressor piston is provided. The method uses a transfer member, a coating material that includes fluororesin and a binder, the coating material being applied to an outer surface of a head of the piston. The method includes separating the piston and the transfer member instantaneously when the coating material has been applied to the entire circumference of the head.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE PREFERRED EMBODIMENTS

Embodiments of the present invention will now be described with reference to the drawings.

Figure 1:
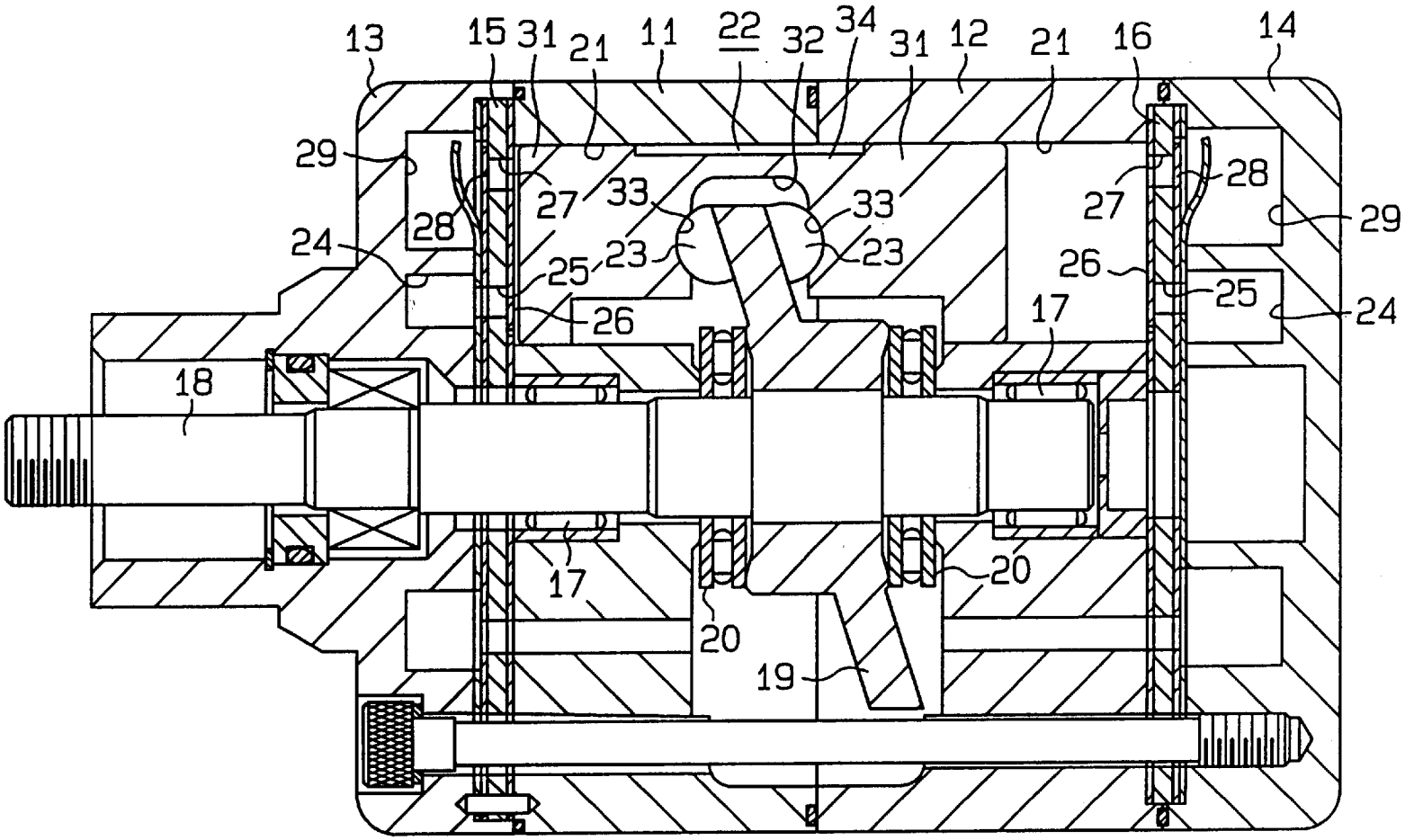
FIG. 1 is a cross-sectional view of a compressor having pistons according to a first embodiment of the present invention.

FIGS. 1 to 5 illustrate a first embodiment. As illustrated in FIG. 1, the compressor includes a pair of cylinder blocks 11, 12 and front and rear housings 13, 14. The cylinder blocks 11, 12 and the housings 13, 14 are made of aluminum alloy. The cylinder blocks 11, 12 are coaxially joined together. The front housing 13 is coupled to the front end of the front cylinder block 11 by way of a valve plate 15. The rear housing 14 is coupled to the rear end of the rear cylinder block 12 by way of a valve plate 16. A drive shaft 18 extends through the center of the cylinder blocks 11, 12 and is supported by a pair of radial bearings 17. A swash plate 19 is fixed to the axial center of the drive shaft 18. The swash plate 19 is held between the cylinder blocks 11, 12 with a pair of thrust bearings 20.

Equally spaced apart cylinder bores 21 are formed in the cylinder blocks 11, 12 about the axis of the drive shaft 18. The axes of the bores 21 define a circle, the center of which coincides with the drive shaft axis. A piston 22 is reciprocally accommodated in each aligned pair of cylinder bores 21. The pistons 22 are made of aluminum alloy. The axial center of each piston 22 is coupled to the periphery of the swash plate 19 by pair of shoes 23.

When the drive shaft 18 is rotated, the swash plate 19 is rotated integrally. The rotation of the swash plate 19 is converted into reciprocation of the pistons 22. This draws refrigerant gas from an external refrigerant circuit (not shown) into cylinder bores 21 through suction chambers 24, suction ports 25 and suction valve flaps 26. The drawn gas is compressed and discharged to discharge chambers 29 through discharge ports 27 and discharge valve flaps 28. The gas is then discharged from the discharge chambers 29 to the external refrigerant circuit.

Figure 2:
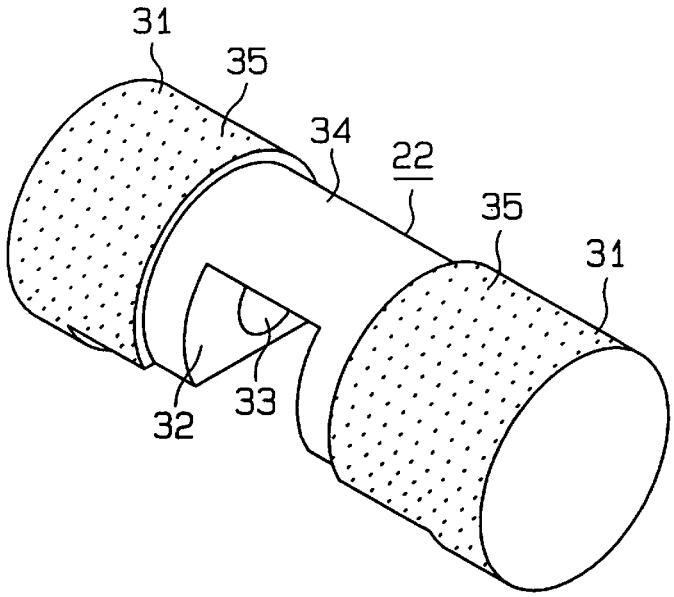
FIG. 2 is a perspective view of the piston shown in FIG. 1.

The structure of each piston 22 will now be described. As shown in FIGS. 1 and 2, the piston 22 is substantially cylindrical and has two heads 31. One of the heads 31 is located in the associated cylinder bore 21 of the front cylinder block 11 and the other head 31 is located in the associated cylinder bore 21 of the rear cylinder block 12. A trunk 34 is located between the heads 31. The diameter of the trunk 34 is smaller than that of the heads 31. A recess 32 is formed in the trunk 34. Shoe seats 33 are formed in the recess 32 for receiving the shoes 23. 4

Figures 4, 5:
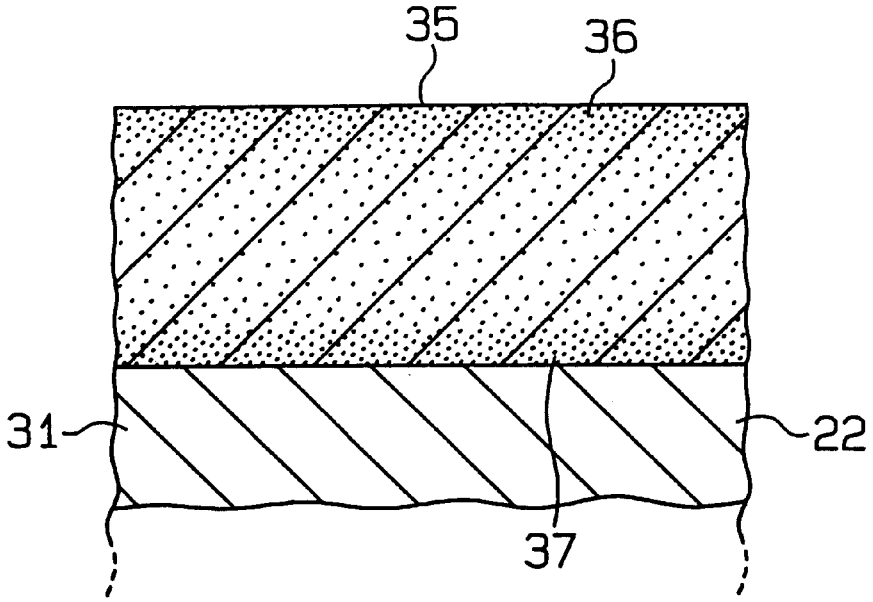
FIG. 4 is an enlarged partial cross-sectional view of a coating layer on the piston of FIG. 2.
FIG. 5 is a table showing the distribution of fluororesin and binder in the coating layer of FIG. 4.

As shown in FIGS. 2 and 4, a coating layer 35 is formed on the circumferential surface of each head 31. The principal components of the coating layer 35 include fluororesin 36 and binder 37. The thickness of the coating layer 35 is tens of micrometers. The weight ratio of the binder 37 to the fluororesin 36 is preferably between 0.8 and 3.0. The coating layer 35 decreases friction between the piston heads 31 and the inner surface of the cylinder bore 21 and improves the durability of the piston 31. The coating layer 35 also seals the cylinder bores 21. As shown in the table of FIG. 5, a relatively great amount of the fluororesin 36 is deposited in the vicinity of the surface of the coating layer 35. A relatively great amount of binder 37 is located near the surface of the piston 22.

The coating layer 35 is formed by a roll coating apparatus 51. The roll coating apparatus 51 includes a pan 52, a metal roll 53, a comma roll 54, a transfer roll 55, a work holder 56 and a driving mechanism (not shown). A coating material C is stored in the pan 52. The metal roll 53 is partialy immersed in the coating material C. The transfer roll 55 is made of synthetic rubber and contacts the metal roll 53. The comma roll 54 is separated from the metal roll 53 by a predetermined distance. The work holder 56 supports the piston 22. The axes of the rolls 53 to 55 and the axis of the piston 22 are parallel. The driving mechanism has a motor to rotate the work holder 56 and the rolls 53 to 55 in the direction of the arrows in FIG. 3. The work holder 56 is supported by a solenoid 57 at its axial ends. Exciting the solenoid 57 instantly moves the piston 22 toward the transfer roll 55. De-exciting the solenoid 57 instantly separates the piston 22 from the transfer roll 55.

When the rolls 53 to 55 and the piston 22 are rotated by the driving mechanism, the coating material C in the pan 52 adheres to the metal roll 53. The viscosity of the coating material C is 40000 to 50000 centipoise (cP). The comma roll 54 adjusts the thickness of the coating material C that has adhered to the metal roll 53. Then, the coating material is applied to the transfer roll 55. The coating material C on the transfer roll 55 is transferred to the heads 31 of the piston 22 as it is pressed against the transfer roll 55. Upon completion of the transfer of the coating material C, the solenoid 57 separates the piston 22 from the transfer roll 55. The viscosity of the coating material C is measured with a BH type viscometer using a No. 7 rotor. During the measurement, the rotor is rotated at 10 rpm.

Thereafter, the coating material C on the piston 22 is dried and cured to form the coating layer 35. The fluororesin 36 and the binder 37 are not significantly soluble with each other. Thus, during the curing of the coating layer 35, the fluororesin 36 moves toward the surface, or toward the air, which does not react chemically with the fluororesin 36. As a result, a relatively large amount of fluororesin 36 is deposited near the surface of the coating layer 35. The binder 37 moves toward the piston 22 and adheres to the piston 22.

Unlike the prior art method, in which the coating layer 35 is ground after being cured, the piston 22 is fitted into a compressor after the coating layer 35 is cured.

The illustrated embodiment has the following advantages.

A great amount of fluororesin 36 is deposited on the surface of the coating layer 35, which permits the piston 22 to slide smoothly along the cylinder bore 21. This improves not only the efficiency of the compressor but also improves the piston seal and the durability of the compressor.

A large amount of binder 37 is located in the vicinity of the piston 22, which firmly adheres the coating layer 35 to the piston 22. Accordingly, the durability of the coating layer 35 is improved.

The coating layer 35 is not ground after being cured. Thus, part of the fluororesin 36 deposited in the vicinity of the coating surface is not removed. Further, omitting the grinding process simplifies the manufacturing procedure.

When the coating material C is applied to the piston 22, the piston 22 is quickly separated from the transfer roll 55. Therefore, the coating layer 35 has a uniform thickness about the entire the piston 22, which allows the grinding process to be omitted. If the piston 22 were slowly separated from the transfer roll 55, the thickness of the coating layer 35 would be uneven. Specifically, when the piston 22 is separated from the transfer roll 55, the coating material C in contact with the transfer roll 55 bulges.

The weight ratio of the binder 37 to the fluororesin 36 is between 0.8 and 3.0. Therefore, the binder 37 firmly fixes the coating layer 35 to the piston 22 and the fluororesin 36 permits the piston 22 to smoothly slide in the cylinder bore 21.

The viscosity of the coating material C is between 40000 to 50000 cP. This viscosity range is not only suitable for the transferring but also prevents the coating material C from dripping when applied to the piston 22. Accordingly, the thickness of the coating layer 35 is uniform.

The coating material C is transferred to the piston 22 by the transfer roll 55, which is parallel to the axis of the piston 22. This arrangement accurately forms a layer 35 of uniform thickness. Also, the arrangement permits the piston 22 to be separated from the transfer roll 55 with a simple structure.

A second embodiment of the present invention will now be described with reference to FIGS. 6 and 7. In this embodiment, each piston head 31 includes a cylindrical portion 31*a* and a tapered portion 31*b*. Each tapered portion 31*b* is located between the piston trunk 34 and the corresponding cylindrical portion 31*a*. The distance between each tapered portion 31*b* and the corresponding cylinder bore 21 increases toward the trunk 34. The difference between the radius of the cylindrical portion 31*a* and the minimum radius of the tapered portion 31*b* is one hundred micrometers at most (The difference is illustrated in an exaggerated manner). The coating layer 35 on the cylindrical portion 31*a* is ground. The axial length of the cylindrical portion 31*a* is substantially equal to that of the tapered portion 31*b*.

A large amount of the fluororesin 36 is deposited near the surface of the boundary between the cylindrical portion 31*a* and the tapered portion 31*b* and in the tapered portion 31*b*. The fluororesin 36 located in the boundary, or the encircled portion in FIG. 7, permits the piston 22 to smoothly slide in the associated cylinder bore 21.

Figure 6:
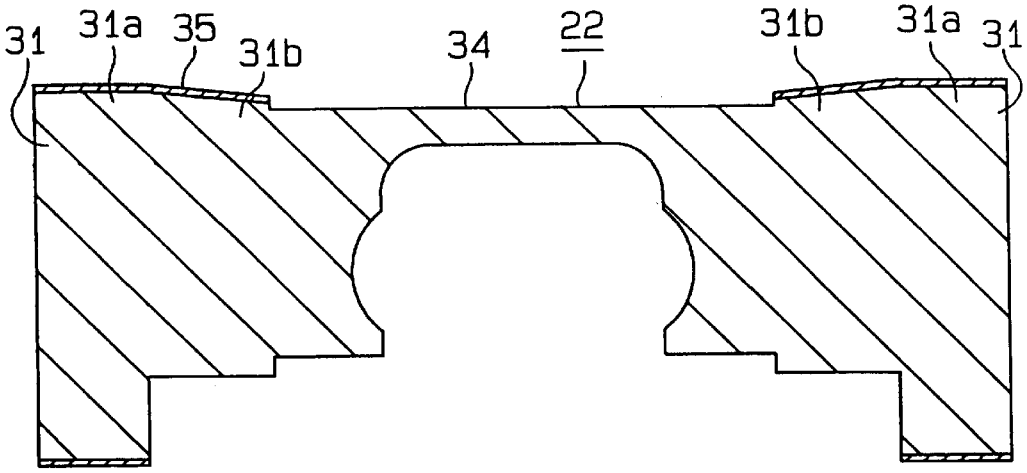
FIG. 6 is a cross-sectional view showing a piston according to a second embodiment.
Figure 7:
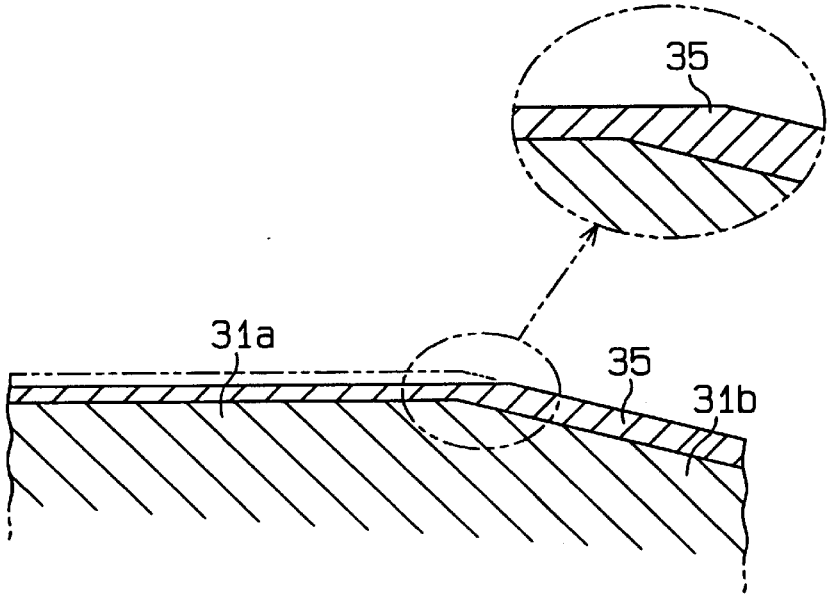
FIG. 7 is an enlarged partial cross-sectional view showing the piston of FIG. 6.

The embodiment of FIGS. 6 and 7 has the following advantages.

The fluororesin 36 deposited in the boundary area between the cylindrical portion 31*a* and the tapered portion 31*b* permits the piston 22 to smoothly reciprocate in the cylinder bore 21. Therefore, like in the embodiment of FIGS. 1 to 5, the compressor operates efficiently.

As the piston 22 reciprocates in the associated cylinder bores 21, the tapered portion 31*b* permits lubricant to be quickly introduced between the cylindrical portion 31*a* and the cylinder bore 21. Accordingly, the piston 22 smoothly reciprocates and has a high wear resistance.

It should be apparent to those skilled in the art that the present invention may be embodied in many other specific forms without departing from the sprit and scope of the invention. Particularly, it should be understood that the invention may be embodied in the following forms.

The viscosity of the coating material C may be changed. If the viscosity of the coating material C is between 5000 and 150000 cP, the material C does not drip when applied to the piston 22. More preferably, the viscosity is between 15000 and 50000 cP.

An agent may be added to the coating material. For example, solid lubricant, the hardness of which is substantially equal to that of the wall of the cylinder bore 21, may be added to the coating material C. The added lubricant resists wear of the coating layer 35 and permits the piston 22 to smoothly reciprocate in the cylinder bore 21. The average particle size of the solid lubricant is preferably equal to or smaller than ten micrometers and more preferably between 1 and 5 micrometers. The hardness of the solid lubricant is preferably between 2.5 and 4.5 in Moh's hardness and most preferably 4.0 in Moh's hardness. Calcium fluoride has these properties.

Figure 3:
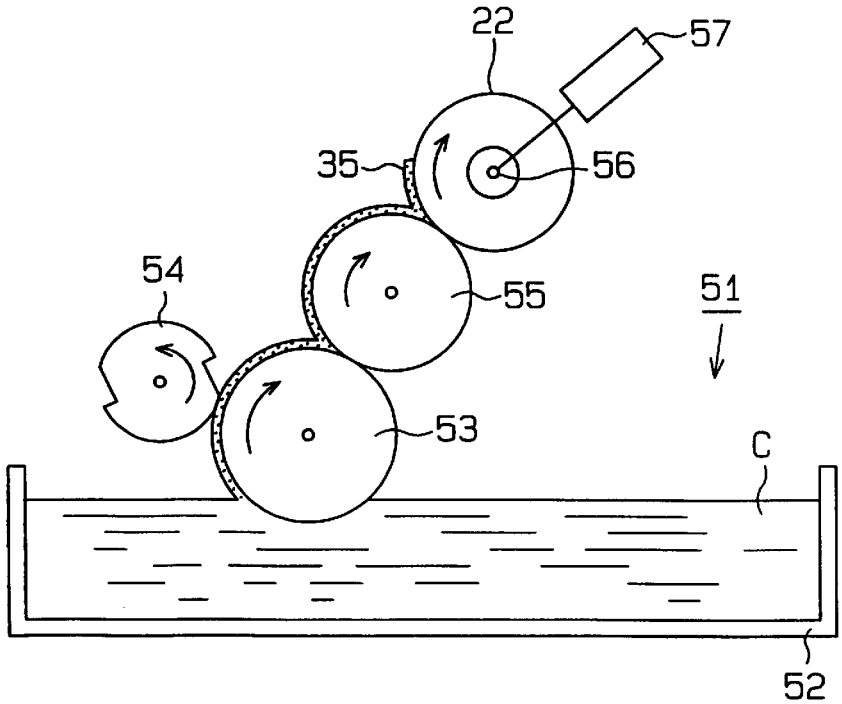
FIG. 3 is a diagrammatic view of a roll coating apparatus.

The coating material C may be applied without using the apparatus 51 of FIG. 3. For example, the coating material C may be applied to the piston 22 by screen coating method. In the screen coating method, a squeegee presses the coating material against a screen. When the application of the material C to the piston 22 is completed, it is preferred that the screen and the squeegee are quickly separated from the piston 22.

Unlike the illustrated embodiments, the transfer roll 55 may be moved away from the piston 22 when the application of the material C is completed.

The present invention may be embodied for manufacturing single headed pistons.

Therefore, the present examples and embodiments are to be considered as illustrative and not restrictive and the invention is not to be limited to the details given herein, but may be modified within the scope and equivalence of the appended claims.

What is claimed is:

1. A piston for reciprocating in a cylinder bore of a compressor, comprising:

a head for contacting a wall of the cylinder bore; and a coating layer formed on an outer surface of the head, the coating layer including fluororesin and a binder, wherein a surface of the coating layer has a relatively high concentration of the fluororesin for reducing friction when the piston reciprocates.

2. A piston of a compressor as recited in claim 1, wherein the head has a cylindrical section and a tapered section, wherein the coating layer covers both the tapered section and the cylindrical section, and wherein a part of the layer that lies over the cylindrical section is removed by grinding.

3. A piston of a compressor as recited in claim 1, wherein the ratio of the weight of the binder to the weight of the fluororesin is in the range of 0.8 to 3.0.

4. A piston of a compressor as recited in claim 1, wherein the coating layer includes solid lubricant additive, the average particle size of which is equal to or smaller than 10 microns and the hardness of which is in the order of 2.5 to 4.5 Moh's hardness.

5. A piston of a compressor as recited in claim 4, wherein hardness of the additive is in the order of 4.0 Moh's hardness.

6. A piston of a compressor as recited in claim 4, wherein the additive includes calcium fluoride.

7. A method of coating a compressor piston using a transfer member, a coating material that includes fluororesin and a binder, the coating material being applied to an outer surface of a head of the piston, the method comprising separating the piston and the transfer member instantaneously when the coating material has been applied to the entire circumference of the head.

8. A method of coating a piston of a compressor as recited in claim 7, wherein the transfer member includes a transfer roll, the axis of which is parallel to the axis of the piston.

9. A method of coating a piston of a compressor as recited in claim 7, wherein the viscosity of the coating material is in the range of 5000 to 150000 centipoise.

10. A method of coating a piston of a compressor as recited in claim 9, wherein the viscosity of the coating material is in the range of 15000 to 50000 centipoise.

11. A method of coating a piston of a compressor as recited in claim 9, wherein the viscosity of the coating material is in the range of 40000 to 50000 centipoise.

12. A method of coating a piston of a compressor as recited in claim 7, wherein one of the piston and the transfer member is supported by a solenoid and the step of instantaneously separating the piston and the transfer member includes exciting or de-exciting the solenoid.

13. A method of coating a piston of a compressor as recited in claim 7, wherein the ratio of the weight of the binder to that of the fluororesin is in the range of 0.8 to 3.0.

14. A method of coating a piston of a compressor as recited in claim 7, including the step of adding solid lubricant particles to the coating material, wherein the particle size is equal to or smaller than 10 microns and the hardness of the particles is in the order of 2.5 to 4.5 Moh's hardness.

15. A method of coating a piston of a compressor as recited in claim 14, wherein hardness of the particles is in the order of 4.0 Moh's hardness.

16. A method of coating a piston of a compressor as recited in claim 14, wherein the particles include calcium fluoride.

* * * * *